United States Patent [19]

Geer et al.

[11] Patent Number: 4,705,260

[45] Date of Patent: Nov. 10, 1987

[54] FURNACE FOR HEATING AND MELTING ZINC

[75] Inventors: Ralph D. Geer, Warren; Robert L. Morgan, Niles; Dexter S. Senek, Cortland, all of Ohio

[73] Assignee: Republic Steel Corporation, Cleveland, Ohio

[21] Appl. No.: 617,830

[22] Filed: Jun. 6, 1984

Related U.S. Application Data

[63] Continuation of Ser. No. 384,968, Jun. 4, 1982, abandoned.

[51] Int. Cl.[4] ..... F27D 1/00

[52] U.S. Cl. ..... 266/78; 266/242; 266/900

[58] Field of Search ..... 266/130, 78, 131, 204, 266/242, 900, 200; 118/429; 422/431, 433, 206, 207, 901

[56] References Cited

U.S. PATENT DOCUMENTS

| | | | |
|---|---|---|---|
| 2,254,809 | 0/1941 | Tharaldsen | 118/419 |
| 2,271,168 | 0/1942 | Booth | 266/240 |
| 2,958,520 | 11/1960 | Fritz | 260/900 |
| 3,115,421 | 12/1963 | Seymour | 427/55 |
| 3,193,891 | 7/1965 | Funk, Jr. | 266/900 |
| 4,223,873 | 9/1980 | Battles | 260/44 |

FOREIGN PATENT DOCUMENTS

| | | | |
|---|---|---|---|
| 961175 | 6/1964 | United Kingdom . | |
| 598962 | 9/1975 | U.S.S.R. | 266/242 |

*Primary Examiner*—Christopher W. Brody

*Attorney, Agent, or Firm*—Watts, Hoffmann, Fisher & Heinke

[57] ABSTRACT

A furnace for heating and melting zinc comprising a reservoir, a movable upper section, pre-heaters supported on the upper section and immersion burners supported on the upper section and extending into the reservoir. The movable upper section can be raised and lowered relative to the level of molten zinc in the reservoir and thereby insure maximum heating efficiency of the zinc. In a preferred imbodiment the pre-heaters and immersion burners are gas fired.

4 Claims, 4 Drawing Figures

FURNACE FOR HEATING AND MELTING ZINC

This application is a continuation of application Ser. No. 384,968, filed June 4, 1982, now abandoned.

TECHNICAL FIELD

The present invention relates a furnace for heating and melting zinc in the galvanization process.

BACKGROUND ART

In the galvanization process, zinc is heated and maintained in a molten state within a furnace or kettle for coating steel. The temperature required is approximately 500° C. (approximately 930° F.). The furnace or kettle is a vital part of the galvanization process because the metal must be maintained at a constant elevated temperature to insure proper coating and the structure and operation of the kettle directly affect the quality of the resulting coating.

Generally, zinc has been heated and melted in iron kettles by applying heat externally to the kettle walls. However, zinc has a tendency to amalgamate with the iron of the kettle, causing the kettle walls to weaken. The product of this reaction, known as dross, is undesirable. Further, the presence of chlorides in the zinc accelerate the chemical reactions between the iron kettle and the zinc. These reactions cause premature kettle failure, which greatly increases the cost of galvanization. Besides the production kettle, holding furnaces used to store the molten zinc when the production kettle is being repaired suffer the same problems.

Merely lining the furnaces and kettles with refractory materials has not been a satisfactory solution, because heating through refractory walls is inefficient and the high temperatures applied to the walls cannot be withstood over extended periods of time.

DISCLOSURE OF THE INVENTION

The present invention relates to a furnace for heating, melting, and holding zinc. The furnace is constructed of non-ferrous refractory materials that minimize dross formation and isolate a metal furnace casing or shell from the contents. The furnace includes a removable top section that carries pre-heaters and non-ferrous refractory immersion heaters for maximum heating efficiency, ease of operation, long life and avoidance of dross formation. The furnace reservoir is preferably positioned at least partially beneath a floor surrounded with sand. A typical furnace is approximately ten feet deep and has a capacity of up to 200 tons of metal.

The detachable upper section, with the supported furnace pre-heaters and immersion heaters, is adjustably supported at a desired level and is easily removed by an overhead crane. The pre-heaters are gas fired and positioned to direct heat within the reservoir toward the walls and bottom of the reservoir for efficient pre-heating of the inside of the reservoir. In a preferred embodiment, there are three pre-heaters; two are directed to the sides of the reservoir and a third is directed to the bottom. Each pre-heater has a jet air, pilot air and main air line as well as a gas line. The main air line provides a standard flame while the jet air line provides a longer flame and accelerates heating.

Prior to the introduction of the zinc charge, the pre-heaters are activated and the reservoir is heated to approximately 370° C. to 430° C. (approximately 700° to 800° F.). Immediately prior to the introduction of the metal into the furnace, the walls are heated further, approximately an additional 40° C. (100° F.). When the desired reservoir temperature is obtained, the pre-heaters are deactivated and molten zinc is introduced into the reservoir either by a pump or other suitable means. The movable furnace top section is lowered close to the surface of the bath and the immersion heaters are activated to raise or maintain the zinc at a temperature of approximately 480° C. to 510° C. (approximately 900° to 950° F.).

During filling of the reservoir the top may be suspended overhead and when filling is complete the top section is lowered into the reservoir and adjusted relative to the metal level in the bath, with the immersion heaters immersed in the molten metal and a minimum space between the upper surface of the bath and the furnace top. A gasket surrounds the edges of the lid and forms a seal between the reservoir walls and the top. This minimizes heat loss and reduces the oxygen present above the bath to minimize dross formation.

The immersion heaters are elongated, gas fired and have a pilot and main air line as well as a gas line. The immersion heaters extend from 3 to 6 feet into the furnace. The length of the immersion heaters is directly dependent on the size of the tank. It is vital that the immersion heaters be constructed of a non-ferrous material, which does not react with zinc. In a preferred embodiment, silicon carbide is used to construct immersion heaters approximately four feet in length.

The above and other features and advantages of the invention will become better understood from the following detailed description.

BEST MODE FOR CARRYING OUT THE INVENTION

Figure 1:
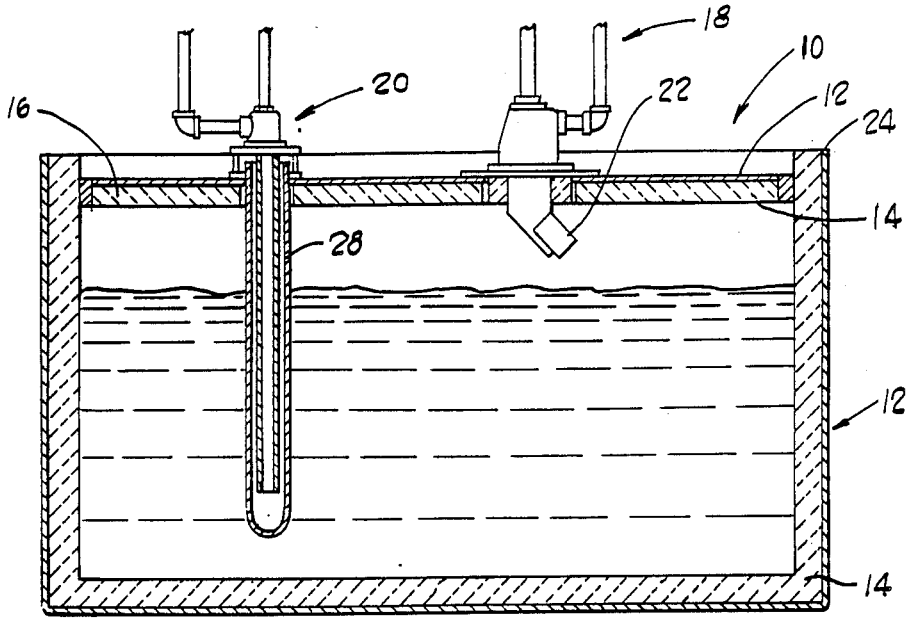
FIG. 1 is a cross-sectional view of the disclosed furnace including a pre-heater and immersion burner.

The furnace of the present invention utilizes a refractory lined reservoir with a movable top wall section containing a plurality of pre-heaters and immersion burners. The immersion burners are constructed of materials which do not react with a molten zinc charge. The movable top wall section can be lowered into the reservoir just above the level of the zinc or raised above the reservoir to facilitate cleaning and loading. These features enable the furnace to be efficiently operated with a minimum amount of energy loss and a minimum of dross formation.

A furnace 10 for heating and melting zinc, embodying the invention, is shown in FIGS. 1 to 4. The furnace is comprised of a steel shell 12 lined with refractory materials 14. A movable wall section 16 of the furnace supports a plurality of pre-heaters 18 and immersion burners 20.

Figure 4:
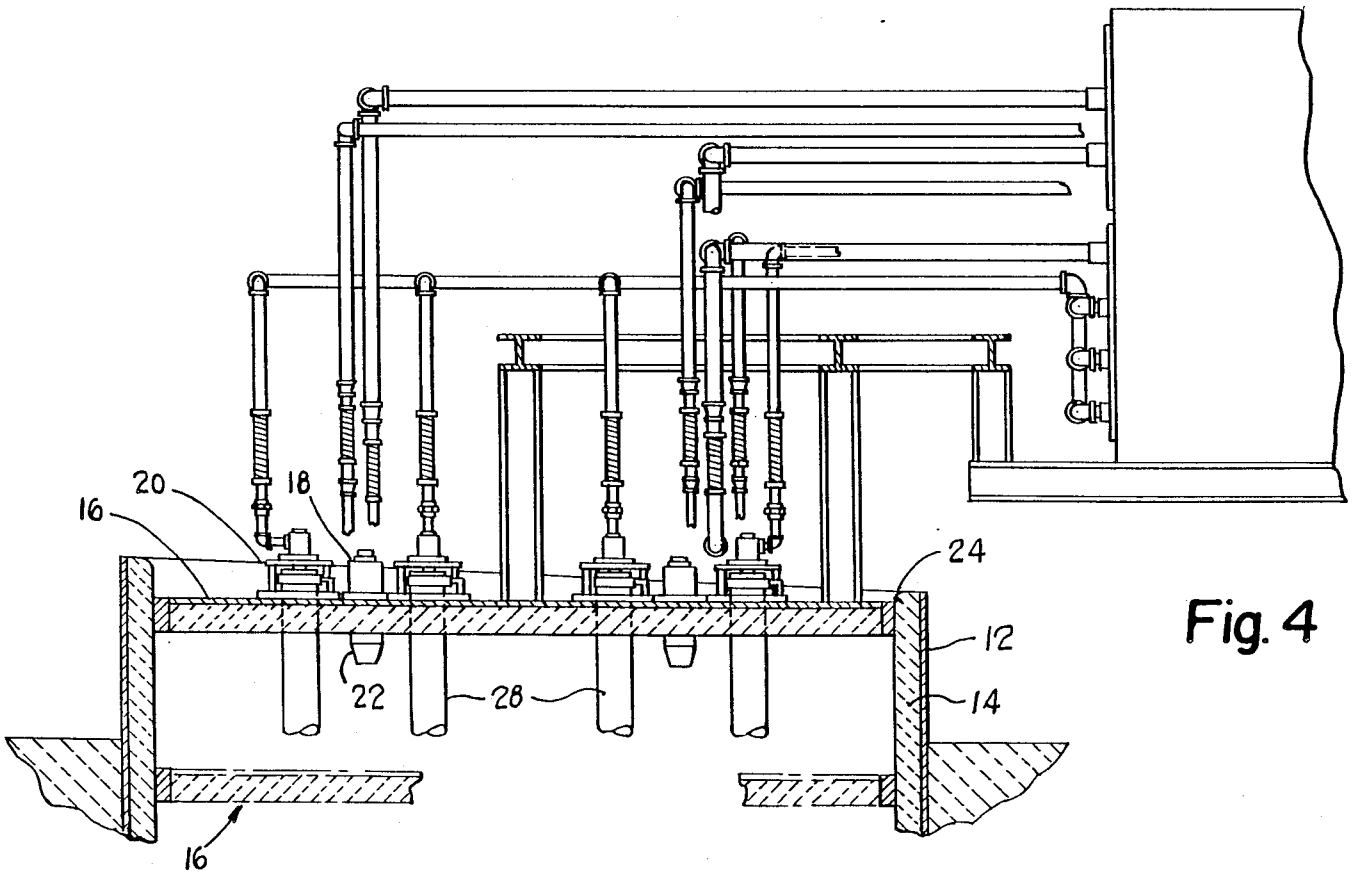

The movable wall section 16 is preferably the top wall and fits within the reservoir side walls. Gasket material 24 surrounds the perimeter of the movable top section and forms a seal with the side walls. The movable top section is raised above the reservoir by an overhead crane (not shown) when the furnace is being filled or repaired. Once the furnace is repaired and a zinc charge is added the movable section is lowered into the bath and a seal is formed between the edges of the movable top wall and side walls. The movable top section is adjusted according to the zinc level as shown in FIG. 4.

Figure 3:
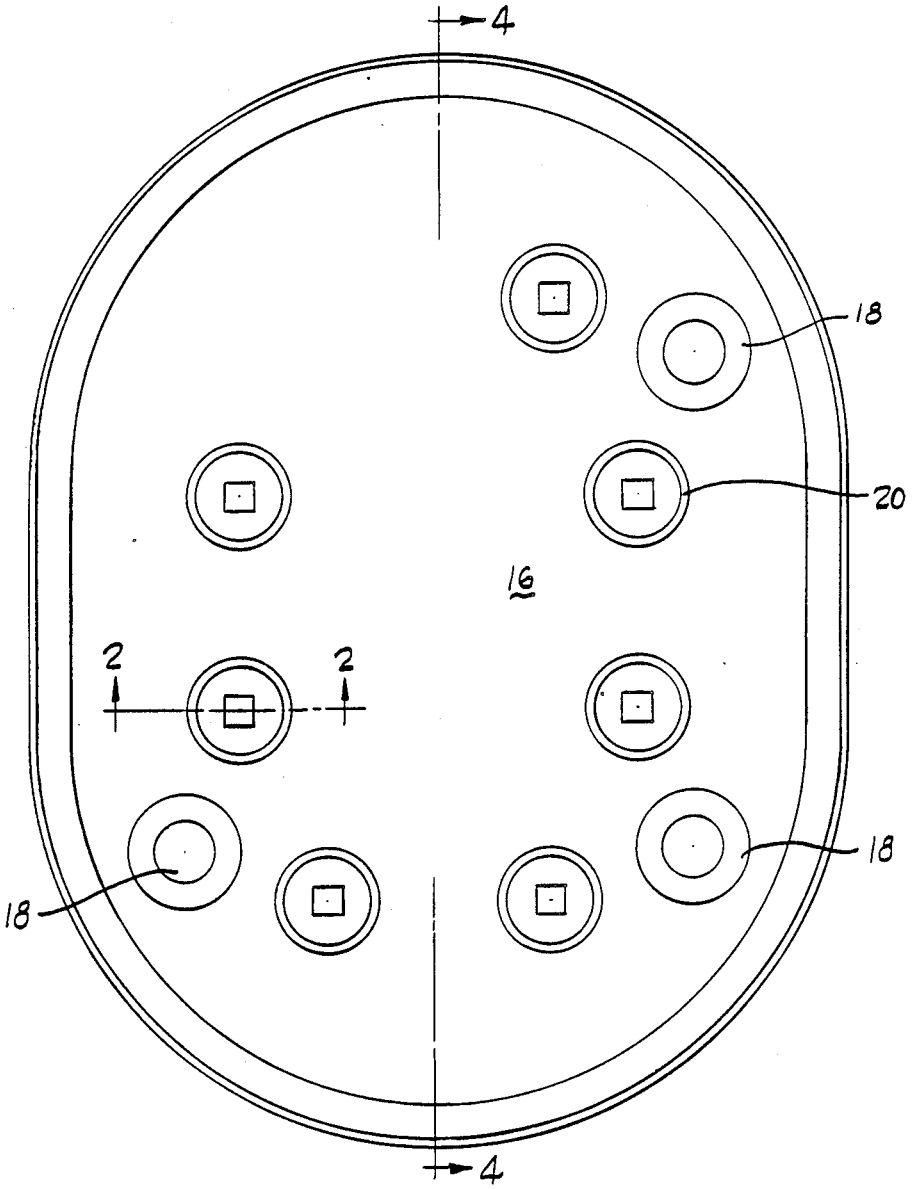
FIG. 3 is a plan view of the movable section of the furnace showing the placement of the immersion burners and pre-heaters; and, FIG. 4 is a cross-sectional view of a portion of the disclosed furnace, movable top section and connecting air and gas pipe lines.

The movable top wall section supports a plurality of pre-heaters 18. Each pre-heater includes a nozzle 22 which during pre-heating is directed to a specific portion of the reservoir. Any arrangement which provides maximum heating efficiency is suitable. In the preferred embodiment, there are three (3) pre-heaters arranged on the movable top wall section as shown in FIG. 3.

In the preferred embodiment, one pre-heater nozzle is directed toward the bottom wall section of the reservoir and the other two (2) pre-heater nozzles are directed toward the inner sides of the reservoir. In the preferred embodiment the pre-heaters are gas fired. Prior to introduction of the zinc into the reservoir, the pre-heaters are activated and the reservoir walls are pre-heated for approximately two days, to a temperature of approximately 370° C. to 430° C. (approximately 700° to 800° F.).

Each pre-heater is connected to a jet air, pilot air and main air lines as well as a gas line (not shown). In the preferred embodiment, each pre-heater has a 1 and ¼ inch jet air line, a 1 inch pilot air line and a 3 inch main air line. The jet air line enables the pre-heaters to produce a longer flame and accellerate heating. There is a 1 inch gas line for each pre-heater.

Before introduction of the molten zinc into the reservoir the walls are heated to approximately 480° C. (approximately 900° F.). Molten zinc having a temperature of aproximately 500° C. (approximately 950° F.) is then pumped into the furnace. The movable top wall section may contain an opening (not shown) that enables the molten metal to be pumped in without removing the movable section.

Figure 2:
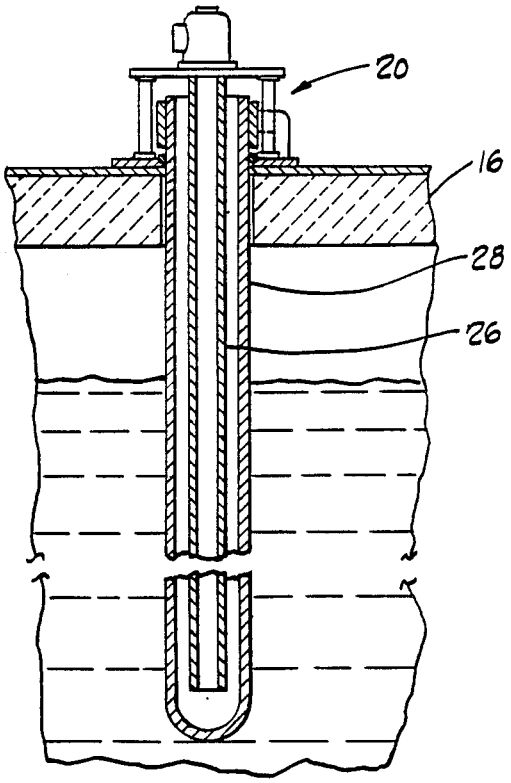
FIG. 2 is an enlarged view of the immersion burner of FIG. 1.

Immersion burners 20 are arranged and supported on the movable wall section as shown in FIG. 3. The burners are positioned on the movable wall section to maximize heat transfer into the zinc. In the preferred embodiment, there are seven (7) immersion burners arranged in the movable top section as shown in FIG. 3. The immersion burners are elongated and extend into the molten zinc and insure maximum heat transfer as shown in FIG. 2. The immersion burners typically range from 3 to 6 feet in length, depending on the depth of the reservoir. In a preferred embodiment, the immersion burners are silicon carbide tubes comprised of an inner tube 26 and an outer tube 28. The preferred burners are approximately 4 feet in length and the furnace is approximately 10 feet deep. Reactions between the zinc and immersion burners are negligible because the burners are constructed of silicon carbide. Each immersion heater has a main air line, a gas line and a pilot air line.

When the reservoir is filled with molten zinc the movable section 16 is lowered into the reservoir to just above the level of zinc in the bath, keeping the pre-heaters above the bath surface. The immersion burners are immersed into the bath to facilitate maximum heat transfer from the burners to the bath. For example, if the bath is only partially filled with zinc, the movable section, including the immersion burners, is lowered into the reservoir just above the bath level, as shown in FIG. 4. The maximum amount of the immersion burner surface area is in contact with the zinc bath. This feature enables efficient and convenient operation of the furnace and minimizes dross formation by limiting the air volume above the bath. The presence of formation of dross can be further minimized by injecting nitrogen into zinc. This causes any dross to rise to the surface of the bath where it can easily be skimmed off.

While a preferred embodiment has been disclosed in detail, various modifications or alterations may be made therein without departing from the spirit or scope of the invention set forth in the appended claims.

We claim:

1. A furnace for heating zinc used for galvanization, comprising:

(a) a reservoir having bottom and side walls, inwardly facing surfaces of which are constructed of non-ferrous refractory materials, and an upper opening;

(b) a vertically movable horizontal furnace lid receivable in the upper opening within the side walls covering the reservoir and adjustable within the side walls in its height from the bottom wall while being maintained horizontal, the inwardly facing surface of said lid being constructed of non-ferrous refractory material;

(c) a plurality of pre-heaters carried by said furnace lid and constructed and arranged to heat the furnace walls before the furnace is charged with zinc by directing heat toward inwardly facing wall surfaces of the reservoir;

(d) a plurality of immersion heaters each having an outer immersible element constructed of non-ferrous refractory material, said heaters carried by said furnace lid and constructed and arranged to be immersed in molten zinc within the reservoir when the lid covers the reservoir, the extent of immersion being controllable by the movable furnace lid; and (e) means including said lid for controlling the extent of immersion of the immersion heaters in the molten zinc within the reservoir.

2. An apparatus for heating and melting zinc, comprising:

(a) a reservoir having walls constructed of non-ferrous refractory materials for containing zinc;

(b) a vertically movable wall portion including a horizontal cover portion substantially closing the reservoir above the level of the contents constructed of non-ferrous refractory materials;

(c) a plurality of immersion heaters supported by said movable wall portion, each including an elongated heating element extending into the interior of said reservoir below the level of the contents and constructed of non-ferrous refractory material;

(d) means including said movable wall portion for controlling the extent of immersion of the immersion heaters in the molten zinc within the reservoir while maintaining said movable wall portion horizontal; and (e) a plurality of non-immersible pre-heaters supported by said movable wall portion and including means for directing heat toward the interior of said reservoir before the reservoir is charged with zinc.

3. The apparatus of claim 2 wherein said immersion heating elements are further comprised of an inner and an outer tube wherein said outer tube encases said inner tube.

4. A furnace for heating zinc, comprising:

(a) a reservoir having bottom and side walls constructed of non-ferrous refractory materials and encased in a metal shell;

(b) a vertically movable, horizontal, furnace upper wall constructed of non-ferrous refractory materials and adjustable vertically while being maintained horizontal within the side walls relative to the level of zinc contained in the reservoir and movable to a position above the reservoir to facilitate repair and loading, said upper wall essentially closing the reservoir;

(c) gasket material surrounding the perimeter of the upper wall and forming a seal between the reservoir side walls and upper wall when the upper wall is within the side walls;

(d) a plurality of pre-heaters supported on said upper wall and wherein each pre-heater contains a nozzle which can be directed toward the inner walls of said reservoir and capable of pre-heating said inner walls to approximately 480° C. prior to the introduction of zinc into said reservoir;

(e) a plurality of immersion burners supported on said movable furnace upper wall, said burners including an elongated heating element constructed of silicon carbide extending downward from the upper wall receivable within the contents of the reservoir; and (f) means including said movable wall for controlling the extent of immersion of the immersion heaters in the molten zinc within the reservoir while maintaining said movable wall horizontal.

* * * * *